US005475950A

United States Patent [19]

Palmer

[11] Patent Number: 5,475,950

[45] Date of Patent: Dec. 19, 1995

[54] FOUNDATION FOOTING FORM ASSEMBLY

[76] Inventor: Thomas M. Palmer, R.R. 1, Box 201, Devils Lake, N. Dak. 58301

[21] Appl. No.: 112,753

[22] Filed: Aug. 25, 1993

[51] Int. Cl.[6] ..... E02D 19/00

[52] U.S. Cl. ..... 52/169.5; 52/293.1; 52/294; 249/6; 249/40

[58] Field of Search ..... 52/293.1, 294, 52/292, 169.5; 249/40, 33, 44, 38, 47, 141, 163, 165, 2, 3, 4, 5, 6, 192; 425/84

[56] References Cited

U.S. PATENT DOCUMENTS

| | | | |
|---|---|---|---|
| 1,046,029 | 12/1912 | Seat | 249/38 |
| 1,090,701 | 3/1914 | Fenske | 249/163 |
| 1,123,769 | 1/1915 | Lightbody | 249/192 |
| 2,458,155 | 1/1949 | Fraser | 249/33 |
| 2,537,684 | 1/1951 | Manuel | 249/165 |
| 2,678,482 | 5/1954 | Cuthbertson et al. | 249/4 |
| 3,017,722 | 1/1962 | Smith | 52/169.5 |
| 3,204,316 | 9/1965 | Jackson . | |
| 3,613,323 | 10/1971 | Hreha . | |
| 3,676,967 | 7/1972 | Frati . | |
| 4,060,217 | 11/1977 | Kirk . | |
| 4,121,804 | 10/1978 | O'Leary | 249/165 |
| 4,300,746 | 11/1981 | Schoen . | |
| 4,673,157 | 6/1987 | Wells . | |
| 4,767,241 | 8/1988 | Wells . | |
| 4,889,310 | 12/1989 | Boeshart | 249/44 |
| 5,120,162 | 6/1992 | Parker . | |

FOREIGN PATENT DOCUMENTS

| | | | |
|---|---|---|---|
| 3436690 | 5/1985 | Germany | 52/292 |
| 0154229 | 9/1984 | Japan | 52/292 |
| 300877 | 5/1968 | Sweden | 249/192 |
| 2154261 | 9/1985 | United Kingdom | 52/263 |

*Primary Examiner*—Carl D. Friedman
*Assistant Examiner*—Laura A. Saladino
*Attorney, Agent, or Firm*—DeWitt Ross & Stevens

[57] ABSTRACT

A lightweight permanent concrete footing form section includes a base sheet that is horizontal with substantially planar upper and lower surfaces. Side walls integral with the base append upward from the base in a generally vertical and planar direction. Ducts are attached to the side walls for carrying water away from the concrete footing after the concrete has been poured and set. Sections may be interconnected and dimensioned according to plans.

16 Claims, 5 Drawing Sheets

FOUNDATION FOOTING FORM ASSEMBLY

FIELD OF THE INVENTION

The invention relates to the art of concrete footing forms and, more specifically, to a lightweight, permanent sectional form including drain tiles integral with the form. The form is manufactured into sections which may be connected together and laid in an excavation as a form for concrete and is intended not to be removed but to remain permanently fixed with the poured concrete.

DESCRIPTION OF THE PRIOR ART

In the art of constructing buildings, it is common practice to cast the base or foundation with concrete. A trench or excavation channel is prepared into which the forms, either made from steel or wood, are set up adjacent and connected to each other matching the dimensions of the required foundation (footing). The forms, which are steel panels or wooden boards or planks, are put into position on their edges across from each other and parallel to each other near the side walls of the trench. Generally, smooth, planar surfaces face each other. The forms are usually secured by stakes after being placed into position. When the footing form is firmly in position an anchoring device may be used to further restrain the forms from movement.

After the forms are completely secured, concrete is poured within the forms and allowed to set and cure. Typically, when the concrete has hardened, the form is removed by a process which is labor intensive, requiring as much physical labor and cost as the initial set up.

When the concrete poured within the forms sets and solidifies and the forms are withdrawn, the typical practice is to place a porus material such as gravel adjacent to both walls of the concrete foundation. Gravel is provided to assist water drainage away from the foundation; therefore, it is usually necessary to provide a conduit such as a tiled duct, also known as a "drain tile," for directing the water away from the foundation to a desired accumulation point.

The conduit leading into the building is generally drained to a sump pump. Similar to the setting up and removal of the foundation footing, the installation of the drain tiles is also a labor intensive operation. A certain amount of retrenching is required before the drain tile can be correctly positioned as close as possible to the foundation footing at the required depth. Although the drainage system is known to the art, a certain amount of skill is required to place the tiles in the correct position and the workmanship often varies with the skills and experience of the worker.

Noteworthy prior art may be found in the U.S. Pat. No. 5,120,162 issued to Parker, the U.S. Pat. No. 3,613,323 issued to Hreha, and the U.S. Pat. No. 3,204,316 issued to Jackson. Parker discloses a permanent concrete footing and foundation form incorporating a drainage system. Because of the permanence of the form, the drain can serve both inside the structure and outside the structure. Hreha discloses a form to be used in casting concrete foundations including a drain tile or duct integral with the form. Jackson discloses a form for casting concrete slabs used in building construction.

A disadvantage of the prior art system of laying foundations is the labor intensive nature of the operation. The removal of the foundation forms is as labor intensive as their placement and securement. Further, the amount of time and labor required to position a drain tile system generally requires the superior skills and experience of the worker and high costs to the builder.

SUMMARY OF THE INVENTION

The present invention is directed to a device which comprises a lightweight concrete footing form having a base sheet with horizontal and substantially planar upper and lower surfaces. Side walls are integrally connected to the base and depend upwardly in a substantially vertical direction. The side walls are planar on the inner surface and outer surface. Attached to the outer surface of each side wall are channels or ducts for directing water away from the foundation.

The sections may be simply carried to the foundation site, laid down and connected to each other end to end. Connection means are provided for allowing each section to align with the prior installed section. Corner sections of various angles are also provided to allow for foundations that have shapes requiring 90° angles or virtually any other size angle. The last section connected to complete a form assembly will attach to the previous section laid and to the first section laid in order to complete the form. A contiguous footing is therefore created by connecting the sections allowing for the pouring of concrete into the form creating a foundation.

The present invention overcomes the prior art disadvantages in that the foundation forms are preformed and are designed to remain adjacent to the poured foundation. Therefore, the labor intensive steps requiring removal of the prior art forms are not required with the present device and assembly since it is meant to remain a permanent part of the foundation.

The device may be used for any type of concrete foundation, but its specific use is for residential construction. The form is made into sections from a polymer material giving each section lightweight characteristics. The sections may be easily moved from one place to another and are constructed such that each section may nest within another section allowing for stacking of up to five or more sections.

Reference is now made in detail to the preferred embodiments of the invention, examples of which are illustrated in the accompanying drawings.

DETAILED DESCRIPTION OF THE PREFERRED EMBODIMENT

Figure 2:
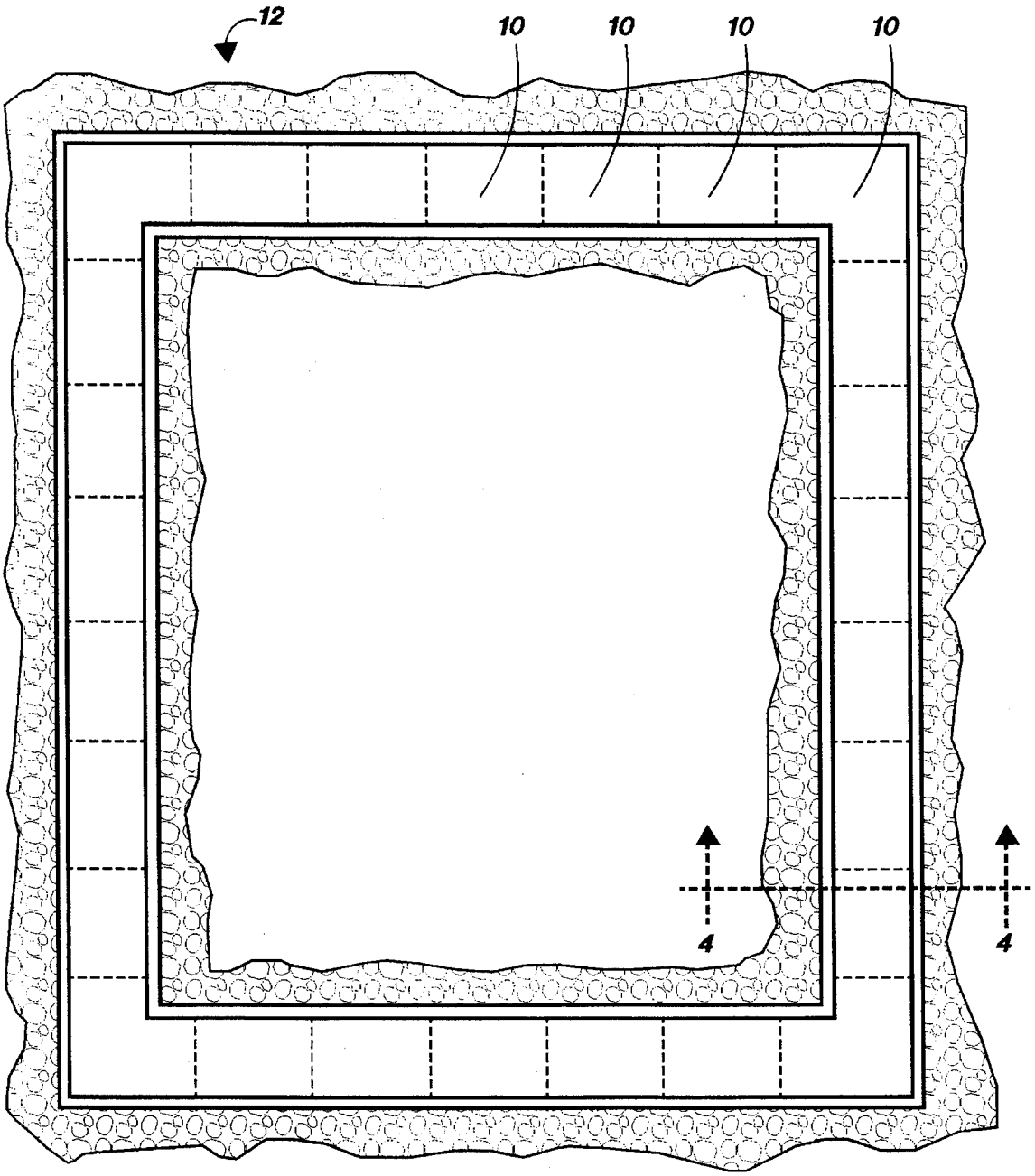
FIG. 2 is a top plan view illustrating the form sections connected in the completed shape of a prospective foundation.

Referring now to the drawings wherein like features are designated by like reference numbers, there is illustrated a footing form section 10, preferably made of lightweight material for ease of handling and reduction of labor. The section 10 is made such that it may be easily connected to another section 10 and installed as the form for a foundation 12, as shown in FIG. 2, and remain as a permanent structure even after the concrete has been poured.

Figure 1:
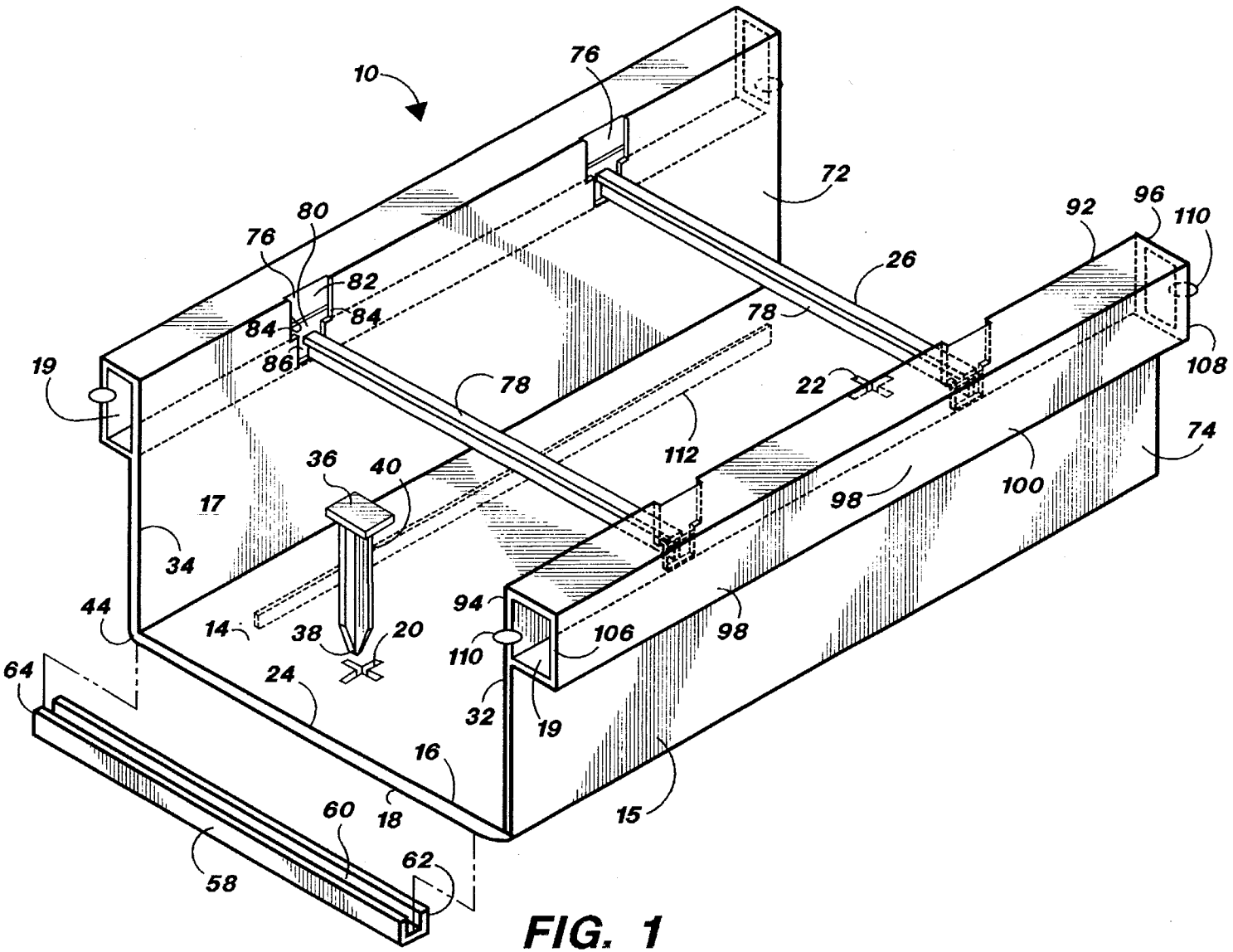
FIG. 1 is a perspective view of a lightweight concrete footing form section.
Figure 3:
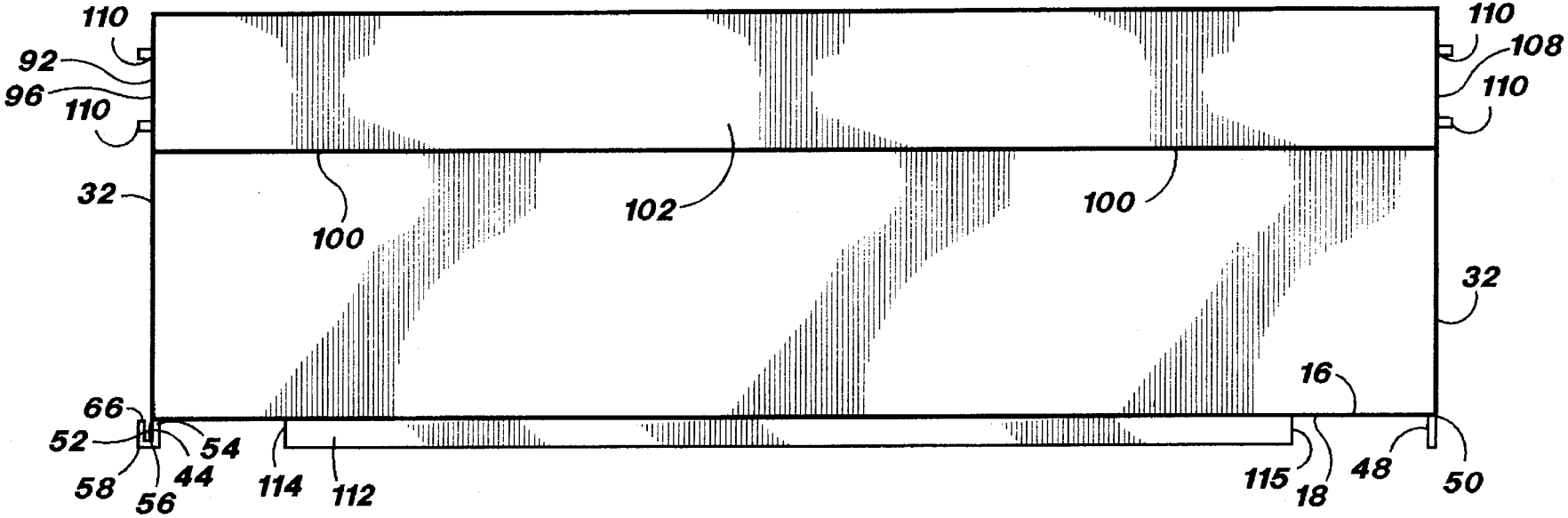
FIG. 3 is a side elevated view of the concrete footing form section of FIG. 1.
Figure 4:
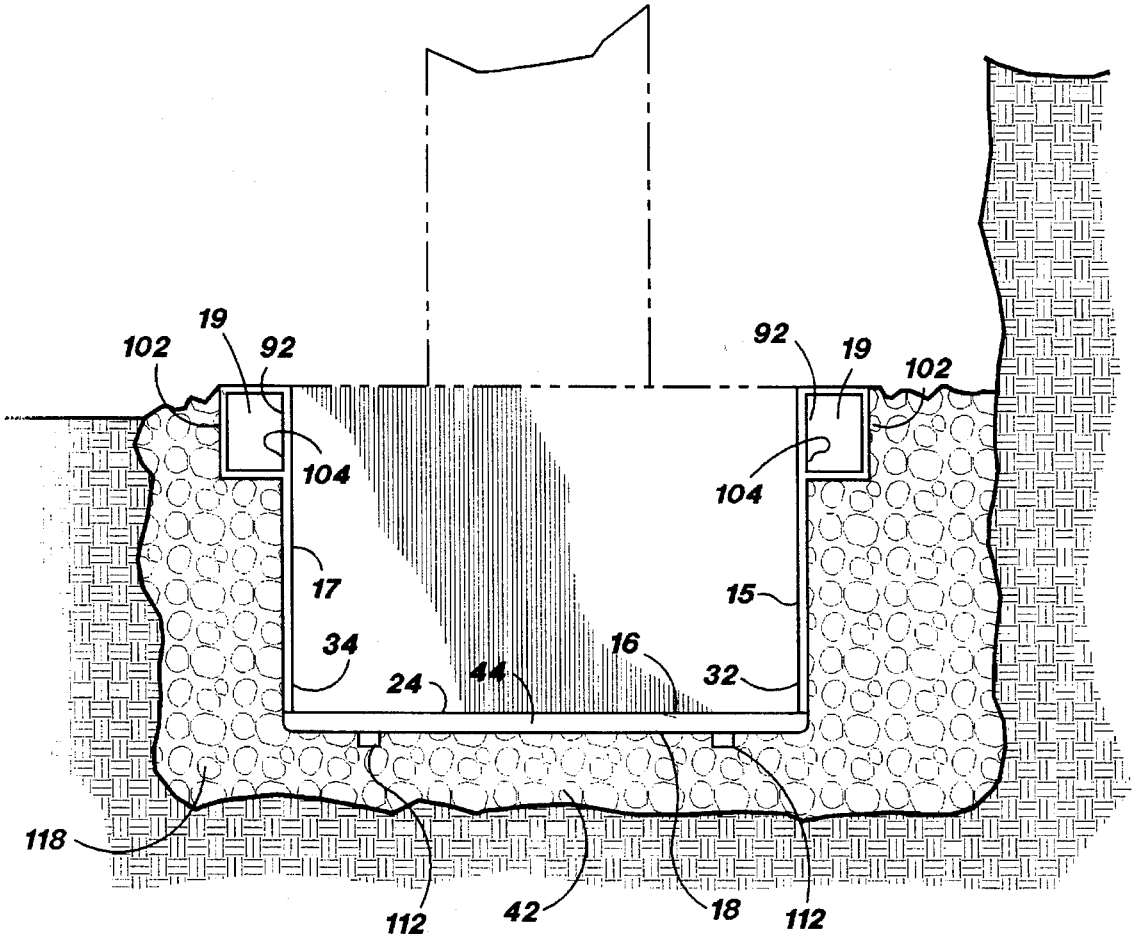
FIG. 4 is a cross-sectional view of the footing form section taken along lines 4—4 of FIG. 2.

The section 10, as shown in FIG. 1, includes a base sheet 14, a first side wall 15 and a second side wall 17, each integral with the base sheet 14 and extending upwardly, and ducts 19 integral with the top portion of each side wall 15, 17. The base sheet 14, which extends the length of the section 10, is molded, in the preferred embodiment, into a thin planar material including an upper surface 16, a lower surface 18, a first end 24, a second end 26, a first side edge 32, and a second side edge 34 as shown in FIGS. 1, 3 and 4. The base sheet 14 may be created according to any dimension in order to perform the task as required by the plans at hand. Modifications may easily be made to the molding of the base sheet 14 as well as to the footing form section 10. Typically, the base sheet 14 is dimensioned such that the upper surface 16 and the lower surface 18 are the same size extending in width from side-to-side approximately two feet and in length approximately four feet.

Figure 5:
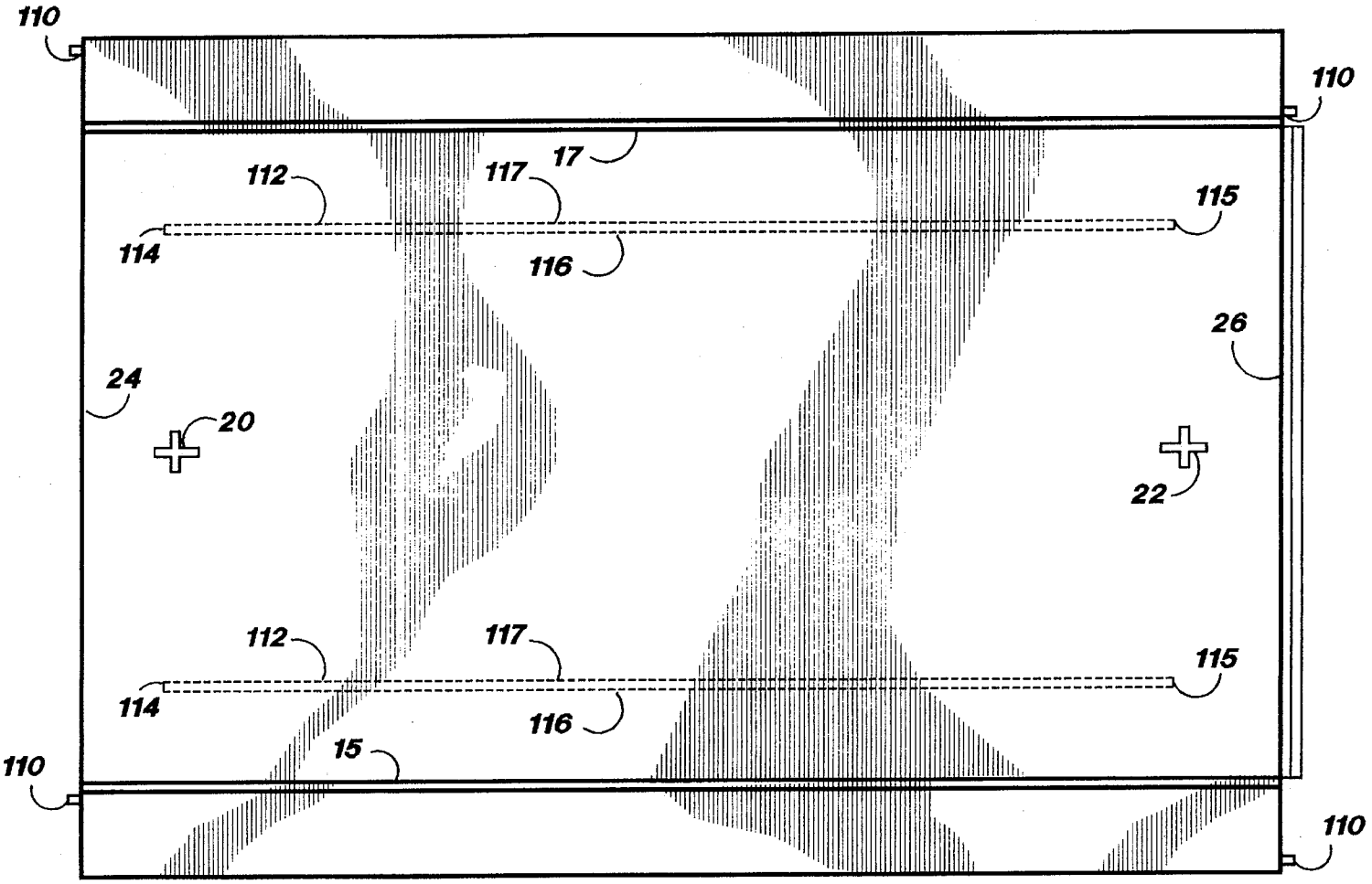
FIG. 5 is a top plan view of the footing form section of FIG. 1, specifically illustrating securing mechanisms.

Preferably, the section 10 defines at least one section stabilizer, illustrated here as a first opening 20 in the base sheet 14 through which a securing member or spike 36 passes. A second opening 22 may also be provided such that the openings are designed to retain a spike 36 as shown in FIGS. 1 and 5. The openings 20 and 22 extend from the upper surface 16 through to the lower surface 18. The first opening 20 is disposed near the first end 24 of the base sheet 14, the second opening 22 is disposed near the second end 26 of the base sheet 14.

In the preferred embodiment, openings 20 and 22 are shaped like a cross in order to receive a complementary shaped spike 36 as shown in FIG. 1. The spike 36 is shaped to be disposed within the openings 20 or 22 to secure movement, in any direction, of the footing form section 10. The spike 36, includes a substantially pointed first end 38, in the preferred embodiment, and a second end 40 for easy insertion within the first opening 20, entering through the upper surface 16 and exiting through the lower surface 18 into the material upon which the base sheet 14 rests. The first end 38 is shaped for easy insertion into the underlying material which is sand 42, in the preferred embodiment, as shown in FIG. 4.

The second end 40 of the spike 36 has a dimension shape to prevent the spike 36 from passing through the first opening 20 into the sand 42 below. The second end 40 will come to rest on the first upper surface 16 of the base sheet 14 when the spike 36 is inserted within the first opening 20. The second end 40 rests on the first upper surface 16 since it is not complementary shaped to fit within the first opening 20.

The section 10 also includes a first lip 44 depending downward from second lower surface 18 of the base sheet 14 shown in FIGS. 1, 3 and 4. A second lip 48, illustrated in FIG. 3, depends from a second edge 50 of the base sheet 14. The lips 44 and 48 have a front side 52 and a back side 54 and a thin bottom edge 56. The lips 44 and 48 are integral with the base sheet 14 and are used as a means to connect a base sheet 14 with another base sheet 14.

A connector 58 is provided to attach to the lips 44 and 48 when the second end 26 of another base sheet 14 is to be connected to a first end 24 of an original base sheet 14. The connector 58, shown in FIGS. 1 and 3, includes a channel 60 for receiving and connecting lips 44 and 48 such that a first end 62 is aligned with the first side end 32 when the connector 58 is connected to the first lip 44 and the second end 64 is substantially aligned with the second side end 34 of the base sheet 14. When connected, the first lip 44 is inserted within the channel 60 as shown in FIG. 3, the second lip 48 of another footing form section 10 may be inserted within a slot 66 to tightly contain the lips 44 and 48 and prevent movement of the footing form section 10. The width of the channel 60 is substantially equivalent to the end widths of the lips 44 and 48 when placed adjacent to each other. The connector 58 is thereby able to hold the two lips in a close fit. The connector 58 further secures the footing form section 10 from movement by being inserted into the sand 42. The sand 42 prevents longitudinal forward and backward movement of connected footing form section 10 in the preferred embodiment.

A first side wall 15 and an opposing second side wall 17 are provided that are integral with the base sheet 14 and which are substantially parallel to each other. A channel is formed by the side walls 15 and 17 along with the base sheet 14, which is shaped to form the wet concrete into a rectangular shape with the side walls 15 and 17 giving the side support for the wet concrete and the base sheet 14 giving the bottom support. In the preferred embodiment, the side walls 15 and 17 depend upwardly from the base sheet 14 in a vertical direction and are dimensioned such that the lengths are similar to the length of base sheet 14 and the heights are approximately one foot. Each of the side walls 15 and 17 are substantially planar, having inner surfaces 72 and outer surfaces 74.

In the preferred embodiment, a shape retaining means 78 is provided to connect the first side wall 15 with the second side wall 17 to prevent the side walls from yielding to pressure of wet concrete that is poured into the section 10. The shape-retaining means 78 also prevents the walls 15 and 17 from bending inwardly from outside pressures such as gravel or sand being poured around the section 10. The shape-retaining means 78 may be permanently attached to the section 10 or may be removable in the preferred embodiment.

Defined by the side walls 15 and 17 are notches 76 as shown in FIG. 1. The notches 76 are dimensioned to receive the shape-retaining means end 80 for a close fit and retention. An upper portion 82 of the notches 76 is dimensioned wider than the shape-retaining means end 80 such that it may be slipped through the upper portion 82 fitting between two side walls 84. The end 80 may then be slid downward into a lower portion 86 such that the end 80, having a larger surface area than the lower portion 86, contacts the outer surface 74 preventing the end 80 from pulling through and further reinforcing the side walls 15 and 17 against outward pressure of poured concrete when the shape-retaining means 78 is in working position. The shape-retaining means 78 may be made from a lightweight material, such as a polymer or aluminum, and may be formed into the shape of a rod or other elongated members.

Referring now to FIGS. 1 and 4, the section 10 is illustrated with ducts 19 for directing ground fluid away from the foundation. Each duct 19 is integral with each of side walls 15 and 17 disposed near an upper end 92 of the outer surface 74. The ducts 19 have a rectangular cross-section, in the preferred embodiment, but may be of any shape depending upon the requirements of the foundation being poured. The ducts 19 include duct first and second ends 94 and 96, duct bottom surfaces 100, duct first outer surface 102 and duct second inner surface 104 as well as duct first side edges 106 and duct second side edges 108.

The length of the side walls 15 and 17 are spanned by the ducts 19 such that a duct first end 94 substantially aligns with the first end 24 of the base sheet 14 and a duct second end 96 substantially aligns with the second end 26 of the base sheet 14. The ducts 19 are integral with the side walls 15 and 17 and molded of the same material; however, it can be envisioned that a similar style duct 19 may be attached to the side walls 15 and 17. In the preferred embodiment, the duct is dimensioned such that the length is substantially four feet, and the width is substantially two and one-half inches.

Referring to FIG. 1, water passages 98 are disposed on a bottom surface 100 of the ducts 19 and provide for a passage of water or other fluids surrounding the foundation, from an outer surface 102 through to an inner surface 104 and vice versa along the length of the footing form section 10. The passages 98 are spaced periodically along the bottom surface 100 according to the fluid removal needs of the foundation being poured. Any shape or spacing may be attributed to the water passages 98 depending upon the circumstances. The duct 19 also has first side edges 106 for edgewise contact with another duct 19 and second side edges 108 in order to connect the ducts 19 with a series of form sections 10.

Links 110 disposed at duct ends 94 and 96 are provided to further connect the sections 10 to each other. As can be seen by FIGS. 1, 3, 4 and 5, the links 110 are strategically placed adjacent to the side edges 106 and 108 such that they extend from the inner surface 104 of the ducts 19 outward beyond the first side edges 106, specifically shown in FIGS. 3 and 5. The links 110 extend from the first side edges 106 and align to fit in close contact with the second end 26 of another section 10 when they are to be connected. The second side edges 108 are to align with the first side edges 106 of the ducts 90 when the sections 10 are connected to each other. As shown in FIG. 1, links 110 adjacent to the first side edges 106 are positioned on opposite sides of the ducts 19 when compared to the links 110 protruding from the second side edges 108 such that when the footing form sections 10 are placed endwise to connect the links 110, the first side edges 106 enter the inner surface 104 of the ducts 19 further connecting footing form sections 10 with each other. In the preferred embodiment, the links 110 snap into an indenture within the inner surface 104 of the complementary section 10. Many other methods of connecting the ducts 19 may be contemplated within the scope of this invention.

In the preferred embodiment, ridges 112 are shown in FIGS. 1, 3 and 5 positioned below and integral with the lower surface 18 of the base sheet 14, including a ridge first end 114, a ridge second end 115, a ridge first side 116 and a ridge second side 117. The ridges 112 are required to further secure the footing form section 10 for movement in a sideways direction since the ridges 112 are inserted within the underlying sand 42, as shown in FIG. 4, which provides a friction force against the sides 116 and 117 of the ridges 112, substantially preventing sideways movement of the footing form section 10.

The ridges 112 append from the base sheet 14, or surface 18, a distance of approximately ¾ inch and lengthwise from substantially the first end 24 of the base sheet 14 at the ridge first end 114 to substantially the second end 26 of the base sheet 14 to the ridge second end 115 as shown in FIG. 5. Of course, the ridges 112 may be dimensioned such that they perform according to the particular requirements of the circumstances at hand.

In use, a connector 58 is slipped onto the first lip 44 in preparation for a coupling with another footing form section 10. A footing form section 10 is laid upon a bottom layer of sand 42 within a trench that is prepared for pouring a foundation according to the specific plans of the job. The ridges 112 along with the first lip 44 and the connector 58 are inserted into the sand 42 to prevent lateral movement or longitudinal movement. A securing member 36 is then inserted within first notch 20 and another securing member 36 is inserted into second notch 22 and hammered into the sand 42 to further secure the footing form section 10 from movement in any direction.

The shape retaining means 78 are then inserted into the notches 76 to prevent the first side wall 15 and the second side wall 17 from bending outwardly as the concrete is poured into the form section 10. Another footing form section 10 may be added by inserting its second lip 48 into the connector 58 adjacent the first end 24 of the base sheet 14 and snapping the links 110 of the duct 19 second side edges 108 with the duct 19 first side edges 106 such that the footing form sections 10 are positioned endwise with the base sheets 14 matching in planar succession and first side wall 15 and second side wall 17 also forming an elongated plane. The ducts 19 for both footing form sections 10 also match, forming elongated ducts 19. The newly connected footing form section 10 may then be secured according to the method applied to the original footing form section 10 and further sections 10 may be added according to the description provided.

A final footing form section 10 will be added to complete the foundation circuit according to FIG. 2 such that a complete circuit has been formed. At this point, gravel 118 as shown in FIG. 4 is poured adjacent the outer surfaces 74 of the side walls 15 and 17 to further protect the side walls 15 and 17 from bending outwardly when the heavy concrete is poured within the form section 10. Concrete, or another forming material, may then be poured within the completed foundation 12 (FIG. 2) and allowed to cure, forming the foundation that will support a structure. The footing form sections 10 are made to remain permanent with the foundation after the concrete or other material has cured, providing a fluid draining system by utilizing the ducts 19 to remove fluid from around the foundation.

As fluid arises along the side walls 15 and 17 outer surfaces 74 up to the water passages 98, the fluid will enter the fluid passages 98 and be directed to a sump or other draining system. Therefore, the fluid level will be prevented from rising above the top of the ducts 19 and the footing form section 10 such that the structure resting upon the footings will not be affected by ground water.

The foregoing is considered as illustrative only of the principles of the invention. Further, since numerous modifications and changes will readily occur to those skilled in the art, it is not desired to limit the invention to the exact construction and operation shown and described. Therefore, accordingly, all suitable modifications and equivalents fall within the scope of the invention.

What is claimed is:

1. A footing form section comprising:

a. a base sheet including substantially planar first and second surfaces, the base sheet further including a first edge, a second edge and two side edges;

b. two substantially planar side walls, the side walls being integral with the base sheet and appending at an angle from the side edges, wherein each side wall includes a first surface integral with the first surface of the base sheet and a second surface integral with the second surface of the base sheet, the side walls further having a first side wall edge integral with the base sheet and an opposing second side wall edge;

c. a duct integral with the second surface of each side wall for directing ground fluid d. a first lip integral with the first edge and a second lip integral with the second edge, wherein each of the first and second lips extend downward below the base sheet; and e. a coupler including a channel for receiving therein the first lip from one footing form section and the second lip from another footing form section.

2. The footing form section of claim 1 wherein the ducts are positioned on the second side wall edges.

3. The footing form section of claim 1 further comprising connecting means for releasibly attaching the footing form section to another footing form section.

4. The footing form section of claim 1 wherein a the coupler extends substantially from side edge to side edge of the base sheet.

5. The footing form section of claim 1 wherein a shape-retaining means having two ends is removably attached to each of the first surfaces of the side walls to prevent inward or outward distortion of the side walls.

6. The footing form section of claim 5 wherein each side wall has a pocket to receive each end of the shape-retaining means.

7. The footing form section of claim 6 wherein the shape-retaining means comprises a beam spanning the width from side wall to side wall formed from lightweight material.

8. The footing form section of claim 5 wherein at least one ridge fixed to and appending from the second surface of the base sheet extends in a direction parallel to the side walls.

9. The footing form section of claim 8 wherein the ridge extends substantially lengthwise on the second surface of the base sheet for preventing the section from slipping in a sideways direction.

10. The footing form section of claim 9 wherein the ridge is integral with the second surface of the base sheet.

11. The footing form section of claim 8 wherein an opening is defined by the base sheet.

12. The footing form section of claim 11 wherein a spike is disposed within and through the opening communicating from the first surface to material below the second surface to anchor the section from movement.

13. The footing form section of claim 12 wherein each duct has an upper wall, lower wall, an inner surface and an outer surface.

14. The footing form section of claim 13 wherein each duct's lower wall defines holes extending from the duct's inner surface to the duct's outer surface for transferring ground fluid for drainage.

15. The footing form section of claim 14 wherein each duct is rectangular shaped.

16. A footing form section comprising:

a. a base sheet including substantially planar first and second surfaces, the base sheet further including a first edge, a second edge and two side edges, and additionally a ridge integrally attached to the second surface and extending from the first edge to the second edge in a direction parallel to the side edges;

b. two substantially planar side walls each respectively integrally attached to the side edges and appending at an angle therefrom, each side wall including a first surface integral with the first surface of the base sheet and a second surface integral with the second surface of the base sheet, with the first and second surfaces of the side walls each including a pocket thereupon, and each side wall further including a first side wall edge integral with the base sheet, and an opposing second side wall edge;

c. a beam having two ends, the beam spanning from side wall to side wall with each end retained within a pocket;

d. a rectangular duct integral with the second side wall edge and positioned on the second surface of each side wall;

e. a first lip integral with the first edge and a second lip integral with the second edge, wherein each of the first and second lips extend downward below the base sheet;

f. a coupler including a channel for receiving therein a first lip from one footing form section and a second lip from another footing form section, the channel having a length extending substantially from side edge to side edge; and e. an aperture extending through the base sheet from the first surface to the second surface, wherein a spike may be inserted and disposed into material adjacent the second surface to anchor the footing form section from movement.

* * * * *